United States Patent [19]

Block et al.

[11] 4,354,319

[45] Oct. 19, 1982

[54] ATHLETIC SHOE

[76] Inventors: Barry H. Block, 25 Fifth Ave., New York, N.Y. 10003; Stanley Beekman, 26670 Loganberry Dr., Richmond Heights, Ohio 44143

[21] Appl. No.: 218,217

[22] Filed: Dec. 19, 1980

Related U.S. Application Data

[62] Division of Ser. No. 29,038, Apr. 11, 1979, Pat. No. 4,262,435.

[51] Int. Cl.[3] ..... A43B 5/00; A43B 23/00

[52] U.S. Cl. ..... 36/114; 36/45; 36/51; 36/77 R; 36/129

[58] Field of Search ..... 36/114, 129, 45, 51, 36/77, 102, 88, 93, 94

[56] References Cited

U.S. PATENT DOCUMENTS

| | | | |
|---|---|---|---|
| 1,974,543 | 9/1934 | Reymond | 36/45 |
| 2,158,153 | 5/1939 | Roberts et al. | 36/51 X |
| 2,507,120 | 5/1950 | Shapiro | 36/51 X |

FOREIGN PATENT DOCUMENTS

| | | | |
|---|---|---|---|
| 323851 | 1/1935 | United Kingdom | 36/51 |
| 448085 | 6/1936 | United Kingdom | 36/45 |
| 527169 | 10/1940 | United Kingdom | 36/51 |
| 1152212 | 5/1969 | United Kingdom | 36/94 |

*Primary Examiner*—James Kee Chi

*Attorney, Agent, or Firm*—Squire, Sanders & Dempsey

[57] ABSTRACT

An improved athletic shoe in which the solepiece has a wedge to facilitate supporting the runner's foot when contacting the ground; the toe box section being provided with pleats to allow expansion for toe movement when the foot flexes; the solepiece is provided with a flexure break segment of reduced thickness following the phalangal-metatarsal joint line of action of the human foot to permit differential flexure of the solepiece in a manner following such lines of action; and the heel part of the solepiece is rounded for optimizing initial and following ground foot contact.

3 Claims, 9 Drawing Figures

ATHLETIC SHOE

This is a division of application Ser. No. 29,038 filed Apr. 11, 1979, now U.S. Pat. No. 4,262,435.

BACKGROUND OF THE INVENTION

Various constructions of athletic shoes are known, particularly such types of athletic shoes as are intended for use by joggers and those engaged in sporting activities involving a considerable amount of running. Such constructions of shoes as exist do not optimally embody in any one shoe construction all of the desirable features as should be contained therein so as to effectively protect the wearer's foot from discomfort, undue strain, injury, and the like. For one thing, such types of shoes invariably do not properly support the foot of the runner as the foot makes contact with the ground during the course of a running stride. In the normal situation, the lateral rear part of the runner's foot at the heel makes contact with the ground first since in a running stride, the legs contact the ground closer and closer to its line of progress thus the feet tend to tilt outwardly. Following such initial contact at the lateral rear corner, the foot should then have a contact course which moves forwardly on the sole and inwardly towards the mid-part of the foot until it approaches the region of the phalangal-metatarsal joints of the foot at which point the line of contact desirably should move toward the medial side and under the phalangal-metatarsal joint of the first metatarsal bone to position and support the foot for push-off at that joint. Since the human foot as indicated tends to turn or tilt outwardly in the course of running, prior art shoes which generally have a flat sole render the runner's foot susceptible to counter-tilting upon making ground contact with such counter-tilt being toward the medial side and frequently of such magnitude that proper lift-off at the first phalangal-metatarsal joint is not possible thereby causing considerable improper strain on the foot with possible consequent injury. Moreover, such forms of athletic shoes as are known for use by runners, do not embody therein sole structure which allows for independent flexure of the sole along the critical metatarsal-phalangal joint. In other words, the human foot, during lift-off in the course of a running stride, bends in one direction along a line of action between the medial side and the second metatarsal-phalangal joint and along a different course of action between the second and fifth phalangal-metatarsal joints. As a result, the lift-off extension of the toes does not follow the position that is desirable since prior art shoes generally bend along a line of action which is generally directed straight transversely of the longitudinal axis of the foot, i.e., extending directly between the first and fifth phalangal-metatarsal joints.

Additional drawbacks of prior art athletic shoes include the lack of same to properly provide a suitable contact surface at the heel to take into account that the foot makes first ground contact high up on the heel with a following heel rotation that oftentimes is improperly supported.

SUMMARY OF THE PRESENT INVENTION

The present invention relates to an improved athletic shoe and is more particularly concerned with an athletic shoe intended for use by runners, i.e., joggers, track athletes and the like.

In accordance with the present invention, the athletic shoe which includes an elongated solepiece having a ground engaging bottom surface and an upper surface on which the wearer's foot is received, and an upper piece secured to the solepiece and providing a close embracing foot structure having a counter section at the rear of the shoe, a mid-body quarter section and a toe box section at the front is designed to facilitate proper supporting of the foot during the course of the running stride. In particular, the solepiece is provided with a thickened body for a substantial part of its length from a location underlying the rearmost part of the counter section and extending forwardly therefrom to a location underlying the toe box mid-body quarter sections juncture, with this thickened body part thus providing a foot supporting wedge structure with the wedge structure having a greater height at the medial side thereof than at the lateral side whereby the foot receiving surface of the solepiece is maintained inclined downwardly from the medial to the lateral side margins of the shoe. Further, the termination of the front reach of the wedge at the medial side is at a location distal the head of the first metatarsal bone of the foot received in the shoe and at the lateral side the front reach of the wedge extends to a location proximal the head of the fifth metatarsal bone. In such manner and by so providing the wedge supporting structure, the foot of the runner which as indicated earlier tilts during the course of the running stride is properly supported on the ground surface when making contact therewith to take into account the inclination of the foot and hence optimally support the foot for subsequent push-off at the first metatarsal-phalangal joint. Desirably the height of the wedge section at the medial side margin of the axis is made greater than that at the lateral side to such an extent as to provide that the foot receiving surface of the solepiece is with respect to a flat ground surface when a substantial expanse of the solepiece ground engaging bottom surface is in contact therewith inclined at an angle of about 6° at the counter section, the inclination diminishing in the direction of the toe box section to about 4° at the front reach region of the wedge (i.e., under the first metatarsal head).

In a further form, the present invention provides that the solepiece region underlying the juncture of the toe box and mid-body quarter sections and constituting a flexure break segment of the solepiece has a reduced thickness, such segment traversing a course which underlies and substantially follows the metatarsal-phalangal joint line of the human foot thereby allowing transverse flexure of the solepiece along said joint line, i.e., in the manner and in correspondence to the foot flexure. In other words, the solepiece readily can flex independently along one line of action between the medial side margin and the second phalangal-metatarsal joint, whereas, between the second phalangal-metatarsal joint and the fifth such joint, the course line is different than that of the first and the natural flexure movement of the foot can be repeated in the solepiece to thereby prevent any undesirable strain on the foot as could occur wherein, for example, bending occurs in prior art shoes along a generally single straight line between the first and fifth phalangal-metatarsal joints. The course the segment follows between the medial and lateral margins of the shoe, is defined by two intersecting straight lines drawn tangentially, respectively, with the ends of the heads of the first and second metatarsal bones as to one line segment, and with the ends of the heads of the second and fifth metatarsal bones as to the other line segment. Such intersecting straight lines or segments include an angle of about 145°. The break segment can be defined by a continuous groove in the solepiece or by a series of end-on-end arranged blind grooves, various cross sections being suitable for the grooves such as parti-circular or rectangular, the grooves preferably having uniform width.

A further feature of the invention provides that to accommodate and allow for the movement of the toes of the foot during the course of running, the toe box section of the shoe upper piece is provided with pleats to allow for expansion of the toe box section to thus accommodate the movement of the toes when the foot is flexed and to thereby eliminate the drawback of excessive friction or like injury and discomfort causing contact of the toe surfaces against the material of the toe box section. Such pleats can be arranged longitudinally of the toe box section or transversely thereof with equal facility.

To enhance support of the toes during the course of the running movement of the foot, an upwardly projecting ridge member is provided in underlying support beneath the second and fourth toes of the human foot and is disposed under the interphalangal joints of such toes.

Further, in order to take into account the feature of the heel making first contact with the ground during the course of a runner's stride and to insure proper heel support as the foot comes to flat positioning on the ground, the shoe of the present invention is provided with a heel surface under the counter section of the shoe which extends upwardly in a curving course from the solepiece bottom surface to joinder with the upper piece at the rear of the counter section with at least a substantial part of the heel part bottom surface following an arcuate course, the radius for which is centered on the calcaneo contact joint axis of the human foot.

The advantageous and further features of the invention will be made more apparent from the following detailed description to be given hereinafter and will be described in terms of such features of construction, combination of elements and arrangement of parts as will be exemplified in the construction set forth and the scope of the invention will be indicated in the claims.

BRIEF DESCRIPTION OF THE DRAWINGS

The invention will appear more clearly from the following detailed description when taken in conjunction with the accompanying drawings in which.

Throughout the following description, like reference numerals are used to denote like parts in the drawings.

DESCRIPTION OF THE PREFERRED EMBODIMENTS

Figure 1:
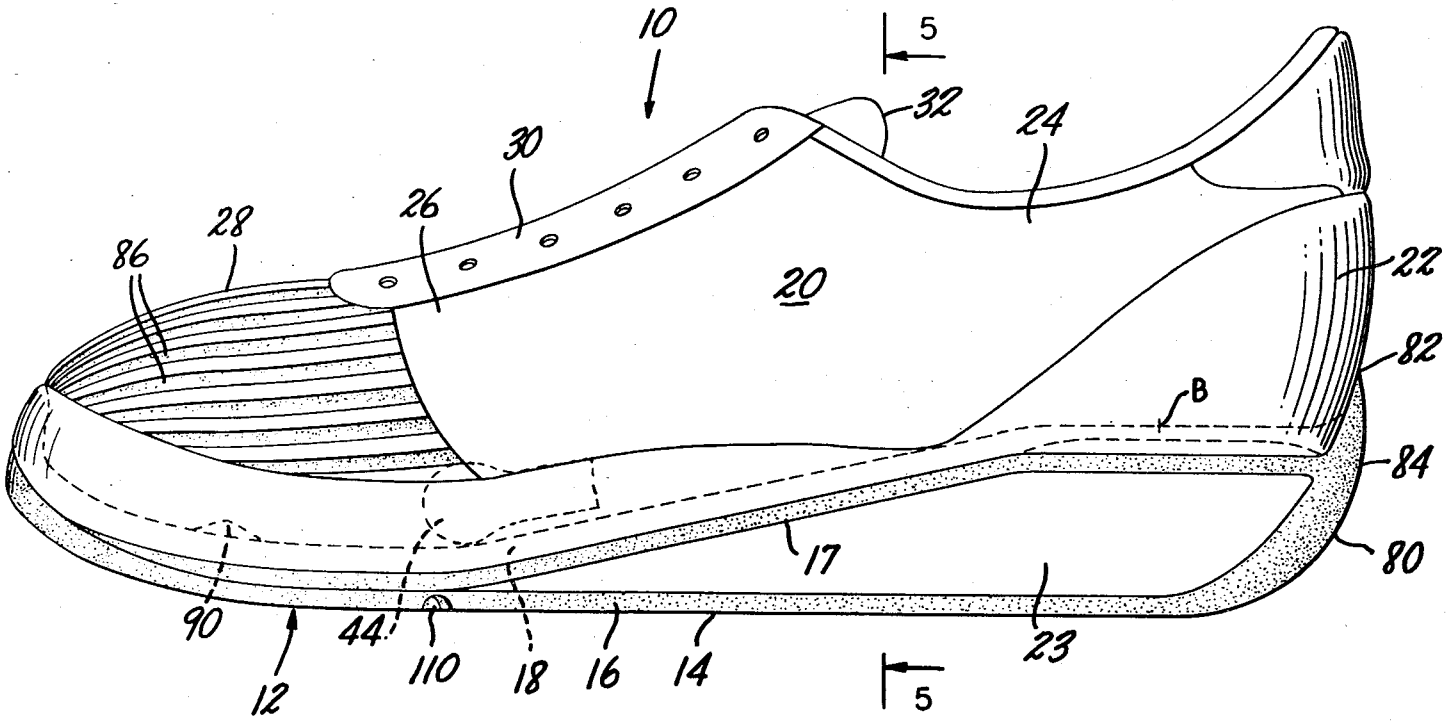
FIG. 1 is a medial side elevational view of an athletic shoe constructed in accordance with the principles of the present invention, and in particular depicting the solepiece wedge and flexure break segment.

Referring now to FIGS. 1–3 and 5 of the drawings, there is depicted an athletic shoe 10 of the present invention and which includes a solepiece shown generally at 12, such solepiece including a ground engaging surface 14, i.e., the outer surface of wear layer 16 with such layer forming the outer bottom structure of the solepiece and being surmounted on the top by a conventional inner sole member 18, the upper surface of which serves to receive the foot of the user. Secured on the top of the solepiece is a shoe upper piece generally denoted at 20 which includes in conventional fashion a counter section 22 at the rear which overlies the heel region of the solepiece and which extends forwardly, the upper further having mid-body rear quarter and front quarter sections 24 and 26, the last part terminating in juncture with a frontmost or toe box section 28. Closure strips 30 for receiving laces in a conventional manner also are provided on the upper piece and the same includes the usual tongue 32.

The solepiece 12 as will be noted has a relatively thickened body as at 23 extending from the region below the counter 22 forwardly a considerable distance following a frontally downwardly inclining course as well as a course which inclines downwardly transversely from the medial to lateral sides of the shoe. The thickened part of the solepiece constitutes a foot supporting wedge which, as will be appreciated by those skilled in the art, is intended to allow for proper support of the runner's foot when making contact with the ground surface since the runner's foot tends to tilt outwardly in the running stride. The wedge section as seen best in FIGS. 1 and 3 extends forwardly to have a front reach in which the wedge section at the medial side of the shoe terminates at a location 46 distal the front of the head 40 of the first metatarsal bone 44 of the human foot. At the lateral side, the wedge terminates at a location as at 50 proximal the front of the head 52 of the fifth metatarsal bone 56.

Since the wedge section is inclined from the medial to lateral sides and since it has a forward reach as thus described, the foot of the runner when contacting the ground with the foot in a normally outwardly tilted attitude, results in there being proper and full supports of the foot as it makes contact with the ground surface. Thus the runner is able to follow through in his running stride in such manner as brings proper support to the foot at the first phalangal-metatarsal joint at lift-off. The foregoing is achieved by providing the wedge structure with a greater height at the medial side thereof than at the lateral side whereby the foot receiving upper surface of said solepiece is maintained inclined downwardly from the medial to lateral side margins of the shoe, the height being such as to provide an inclination of said solepiece foot receiving upper surface with respect to a flat ground surface when a substantial expanse of the solepiece bottom surface is in contact with the ground of about 6° at the counter section of the shoe, with such inclination diminishing in a forwardly direction such that it is an angle of about 5° at the location of the outer end of tongue 32 (FIGS. 1 and 5) and about 4° at the front reach region of the wedge (i.e., under the first metatarsal head).

The relatively thickened part 23 as shown in FIG. 1 also serves as a shock layer and can thus be provided from any one of a number of suitable cushioning materials commonly employed in shoes for that purpose. The outer wear layer 16 and the upper support layer 17 of the solepiece are provided of common material which can be of somewhat better wearing character than the shock layer.

Figure 6:
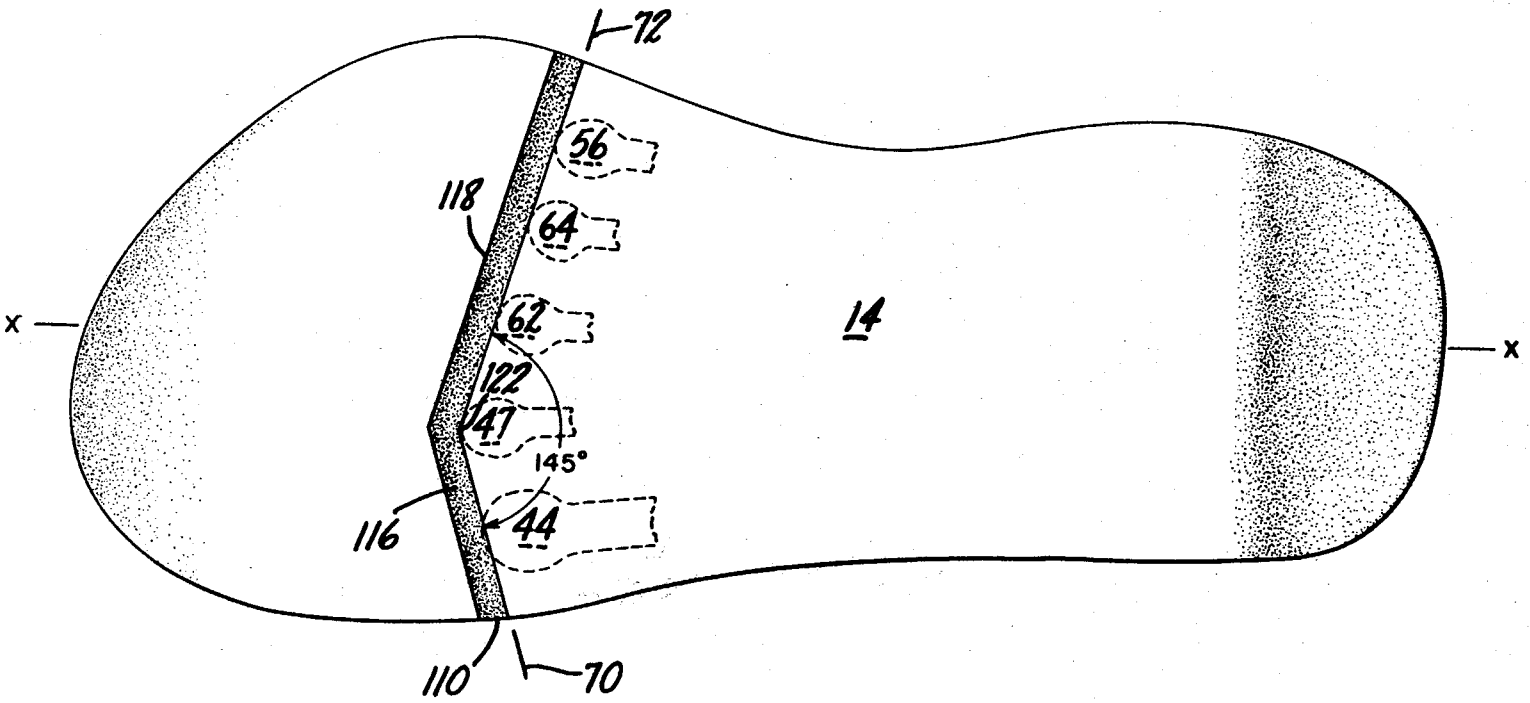
FIG. 6 is a view similar to FIG. 4 except that the flexure segment is defined by a continuous groove extending between the solepiece medial and lateral margins.
Figure 7:
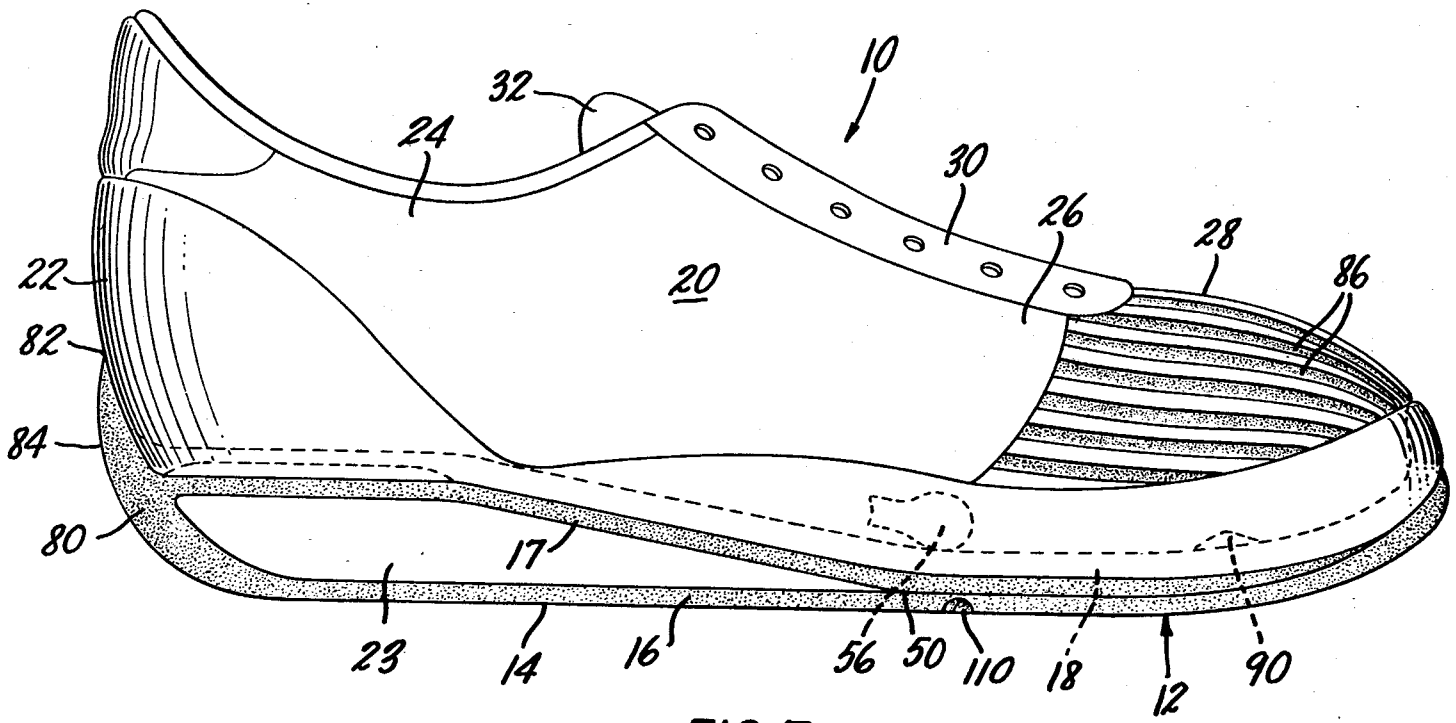
FIG. 7 is a lateral side elevational view of the athletic shoe depicted in FIG. 1.

The invention also provides to take into account the flexure of the foot in running motion and particularly as the foot is flexed at the instant of lift-off, that the under surface of wear layer 16 of the solepiece 12 be provided in the region thereof underlying the juncture of the toe box and mid-body quarter sections with a reduced thickness region defining a flexure break and traversing between the medial and lateral side margins of the shoe a course which underlies and substantially follows the metatarsal-phalangal joint line of the human foot therey allowing transverse flexure of said solepiece along said joint line. Such arrangement will be further described with reference to FIGS. 1, 4, 6 and 7. The solepiece wear layer 16 is provided with a reduced thickness under the above noted juncture which can be defined in a number of ways, for example, by a continuous groove 110 (FIG. 6) or by a series of closely end-on-end arranged and spaced blind grooves 112, the continuous groove 110 or blind grooves 112 following the course described above, i.e., following the course of the joint line of the metatarsal-phalangal line of the human foot. As will be noted in FIGS. 4 and 6, the first to fifth metatarsal bones of the human foot are designated by reference numerals 44, 47, 62, 64 and 56. When the foot bends at lift-off, there is a different line of action in the foot structure at the medial side of the foot between the first and the second phalangal-metatarsal joints than that which occurs between the second and fifth phalangal-metatarsal joints. In order to allow for this movement or lines of action as occur in the human foot, the flexure segment is disposed on the solepiece to permit independent flexure along a course of movement having two branches 116, 118 rather than in a relatively straight transverse course between the first and fifth interphalangal-metatarsal joints as is commonly found in prior art constructions. For such purpose, the flexure segment is arrayed and disposed in correspondence to two intersecting lines 70, 72 which define the metatarsal-phalangal joint line comprised, respectively, of straight lines drawn tangentially with the ends of the heads of the first and second metatarsal bones and tangentially with the heads of the second and fifth metatarsal bones. The line segments 70, 72 intersect as at 122 and include an angle of about 145° as shown in FIGS. 4 and 6.

Figure 4:
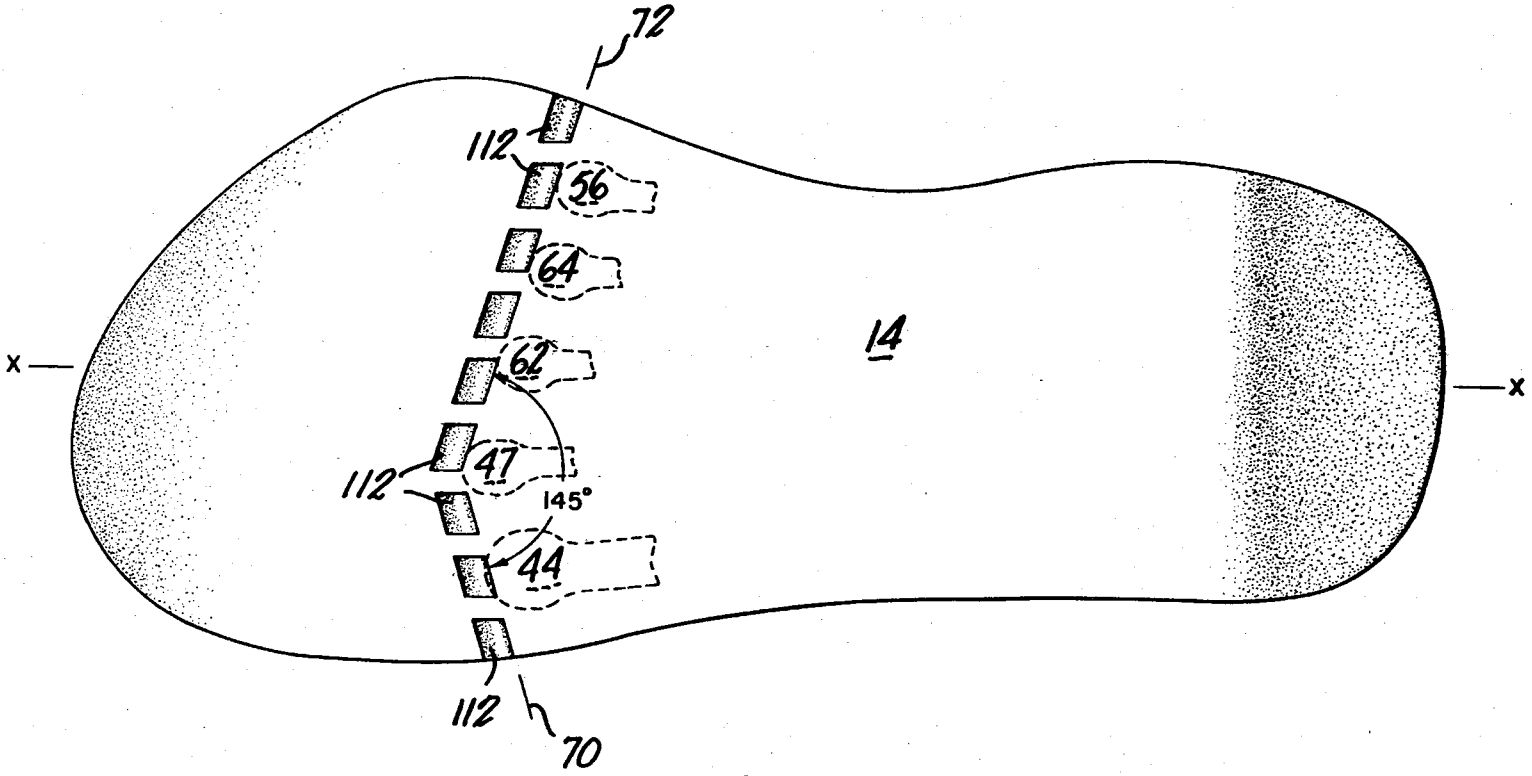
FIG. 4 is a bottom view of the ground engaging surface of the solepiece and depicting one form of flexure break segment defined by blind grooves formed therein.

The continuous grooves 110 or the blind grooves 112 can be provided with various cross sectional configurations, for example, the parti-circular grooves 110 (FIG. 1) or the rectangular section blind grooves 112 (FIG. 4).

Figure 2:
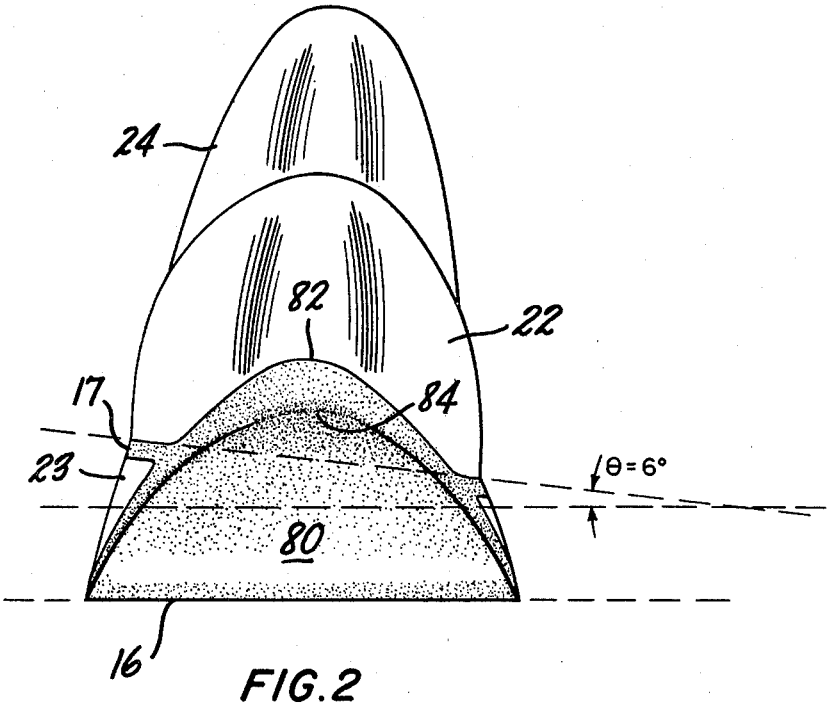
FIG. 2 is a rear view of the shoe depicted in FIG. 1 and illustrating the manner in which the shoe foot receiving surface is inclined from the medial to lateral side margins and the manner of curving the heel part of the solepiece.
Figure 5:
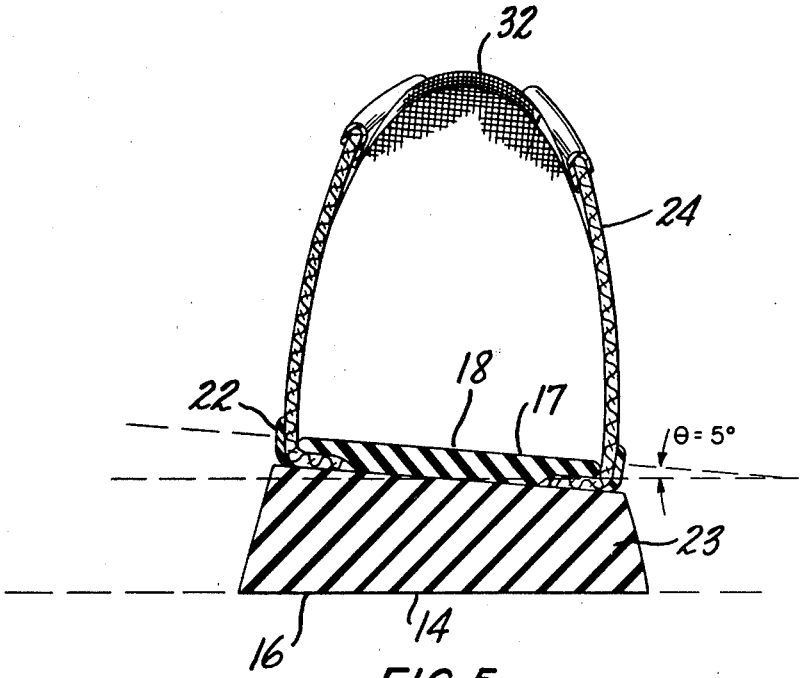
FIG. 5 is a section view taken along the line 5—5 in FIG. 1.

To ensure proper contact of the heel upon making its initial engagement with the ground during the course of the running stride, the heel section 80 of the solepiece as seen in FIG. 1 and which underlies the counter section and extends in an upwardly curving course to merger with the rear of the counter section 22 of the shoe as at 82, is made in the form of a surface (for at least a substantial portion of the heel section as denoted at 84 in FIG. 2) to be of arcuate character, the radius of which passes through the calcaneo contact joint axis B of the human foot (FIG. 1). In such manner, the first contact of the heel with the ground is optimized and as the foot pivots forward, it is fully supported in a rolling contact course until the solepiece is in substantial contact with the ground surface.

Figure 3:
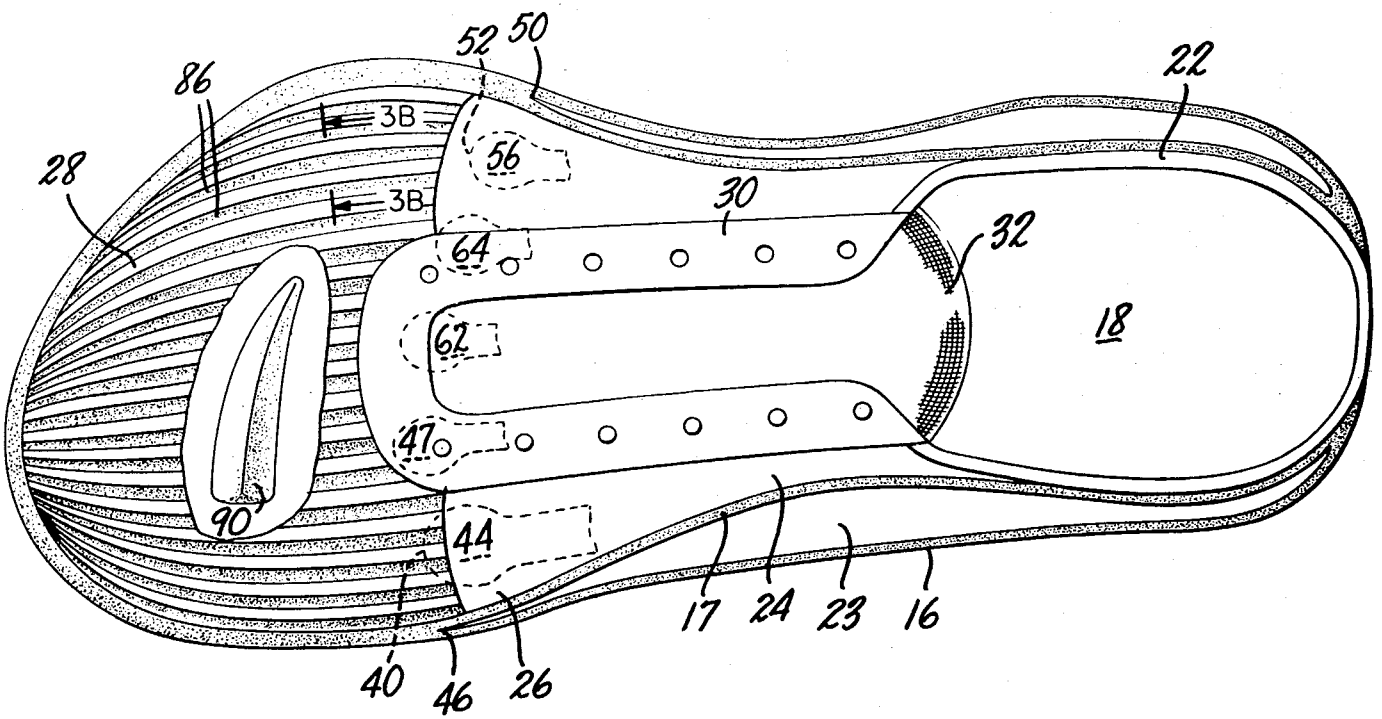
FIG. 3 is a top plan view of the shoe shown in FIG. 1, a portion of the pleated toe box section being broken away to depict with clarity the construction of the toe supporting ridge member on the insole.
Figure 3A:
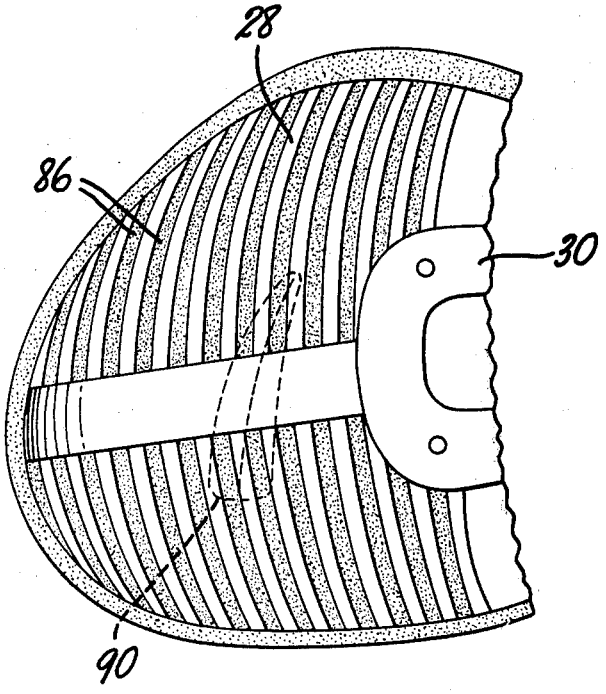
FIG. 3A is a fragmentary plan view of an alternate form of pleating arrangement on the toe section of the shoe.

In accordance with the invention and to take into account the flexure of the toes relative to the remainder of the foot during the course of running, and particularly to obviate the difficulties as are encountered when wearing prior art types of athletic shoes and which can result in undue abrasion and blistering of the toes of the runner because the toe box section cannot expand, the toe box section 28 of the shoe is provided as seen in FIGS. 1 and 3 with a series of longitudinally extending pleats 86. The pleats 86 generally are of about ⅛" in height and render the toe box section material expansible when the toes are bent upwardly relative to the rest of the foot in the course of flexure of the same. This capacity for enlargement of the size of the upper piece foot enclosure permits the movement of the toes without bringing them into an undesirable frictional engagement with the toe box section material.

Figure 3B:
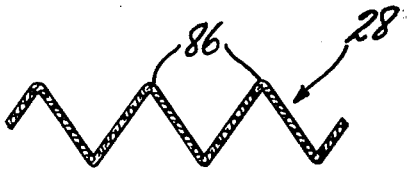
FIG. 3B is a section view taken along the line 3B—3B in FIG. 3.

FIG. 3B depicts the same feature of the pleated toe box section of the shoe except the pleats 86 are disposed in an attitude wherein they are extended transversely of the shoe longitudinal axis.

In addition to allowing for movement of the toes during the course of the running stride, the toes are additionally supported to the extent of providing an upwardly projecting ridge member 90 (FIGS. 1 and 3) which underlies and supports the second to fourth toes of the human foot at a location under the interphalangal joints of such toes.

What is claimed is:

1. An athletic shoe comprising:

an elongated solepiece having a ground engaging bottom surface, and an upper surface on which the wearer's foot is received, and an upper piece secured to said solepiece, said upper piece providing a close encircling foot enclosure extending from a counter section at the rear of the foot to a toe box section at the front, said upper piece toe box section being provided with pleats rendering said toe box section expansible when the remainder of said upper piece is flexed relative to said toe box section.

2. The athletic shoe of claim 1 in which said pleats are disposed transversely of said toe box section.

3. The athletic shoe of claim 1 in which the upper surface of said solepiece is provided with an upwardly projecting ridge member for underlying and supporting the second to fourth toes of the human foot under the interphalangal joints of such toes.

* * * * *